United States Patent [19]

Jahn

[11] Patent Number: 4,706,601

[45] Date of Patent: Nov. 17, 1987

[54] DEVICE FOR APPLYING MEDIUM AFTER TERMINATION OF THE PRINTING OPERATION IN A PRINTING MACHINE

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 735,954

[22] Filed: May 20, 1985

Related U.S. Application Data

[63] Continuation-in-part of Ser. No. 626,732, Jul. 2, 1984, abandoned.

[30] Foreign Application Priority Data

Jul. 5, 1983 [DE] Fed. Rep. of Germany ..... 3324096

[51] Int. Cl.[4] ..... B05C 1/02; B05C 11/10

[52] U.S. Cl. ..... 118/46; 118/211; 118/236; 118/249; 118/262

[58] Field of Search ..... 118/46, 236, 249, 104, 118/203, 211, 247, 262

[56] References Cited

U.S. PATENT DOCUMENTS

| | | | |
|---|---|---|---|
| 1,720,733 | 7/1929 | Joplin | 118/203 |
| 1,880,070 | 9/1932 | Becker | 118/46 |
| 3,931,791 | 1/1976 | Preuss et al. | 118/236 |
| 4,372,244 | 2/1983 | Rebel | 118/46 |

FOREIGN PATENT DOCUMENTS

| | | | |
|---|---|---|---|
| 2020584 | 8/1972 | Fed. Rep. of Germany . | |
| 2345183 | 3/1975 | Fed. Rep. of Germany . | |
| 3046257 | 6/1982 | Fed. Rep. of Germany . | |
| 763417 | 4/1934 | France | 118/46 |

*Primary Examiner*—Evan K. Lawrence

*Attorney, Agent, or Firm*—Herbert L. Lerner; Laurence A. Greenberg

[57] ABSTRACT

In a printing machine, a medium applicator disposed downstream of printing units of the machine, in travel direction of a sheet which has been printed, the applicator having three rollers including a first roller for taking up medium from a supply container, a second roller for metering a quantity of the medium to be applied, and a third roller having the same diameter as that of cylinders of the printing units for transferring the medium, includes a rubber lining disposed on the third roller for directly applying the medium onto the printed sheet; the three rollers, during application of the medium, being in constant meshing engagement with a sheet-transferring cylinder; a device for uncoupling the three rollers from the sheet-transferring cylinder, and a separate motor for driving the three rollers when the rollers are uncoupled.

6 Claims, 6 Drawing Figures

DEVICE FOR APPLYING MEDIUM AFTER TERMINATION OF THE PRINTING OPERATION IN A PRINTING MACHINE

This is a continuation-in-part application of Ser. No. 626,732, filed July 2, 1984, and now abandoned.

The invention relates to a device in printing machines for applying a medium, such as lacquer, especially, by means of three rollers, after the printing process has been terminated, the rollers including a first roller for taking up medium from a supply container, a second roller for metering a quantity of the medium to be applied and a third roller having the same diameter as that of cylinders of the printing units for transferring the medium to a printed sheet.

A lacquering or varnishing device in printing machines has become known theretofore from German Published Non-Prosecuted Application No. (DE-OS) 30 46 257. This device includes a lacquer storage tank or supply container and a scooping roller dipping into this tank. The lacquer taken up by the scooping roller is fed in metered fashion to an applicator roller. Two ductor rollers, by means of which a format-related lacquer feed occurs, can be set close to the scooping roller. A ductor blade applicable against the metering roller is also provided. This ductor blade serves to wipe superfluous lacquer from the metering roller and to return it to the supply container.

A specific disadvantage of this heretofore known device is that the lacquer is fed to the varnishing or lacquering cylinder via a distributor roller and an applicator roller. Because of the relatively long transport distance which the lacquer has to cover over many rollers until it reaches the printed sheet, the lacquer begins to set i.e. no quick-drying lacquers can be used. Due to this limitation to slowly drying lacquers, when the sheet is delivered the reverse side or back of the next following sheet will smear the lacquer and thus paste the sheets together. Consequently, no full sheet piles can be set up, because the pile weight which is built up at the delivery end and which applies a load to the individual sheets also limits the lacquer layer thickness.

In the device described in German Pat. No. 23 45 183 for applying a medium there are provided a dipping roller, a metering roller, an applicator roller, a back-pressure cylinder, a form cylinder and another applicator roller. The two applicator rollers, the dipping roller and the metering roller are combined into a common structural unit. Within this structural unit, either the dipping roller with the form cylinder or the first applicator roller with the form cylinder or the second applicator roller with the back-pressure cylinder can cooperate.

A disadvantage of this last-mentioned construction is that the lacquer must first be fed to the printed material via the form cylinder. The platen mounted on the clamping device at the form cylinder forms a channel in which the lacquer accumulates after a given operating time. This lacquer-accumulation results in an irregular lacquer application due to dripping of the lacquer down onto the printed material.

German Pat. No. 20 20 584 is based upon a device for avoiding smearing of the ink due to lacquering. By means of a lacquering unit, the lacquer is applied to a printing- unit cylinder. This printing-unit cylinder, which has the same diameter as that of the cylinders of the preceding printing units, transfers the lacquer to the printed material. The disadvantages referred to hereinbefore are also applicable to this construction and require additionally, time-consuming cleaning work to be performed on the rollers. Moreover, the construction of the printing unit is complicated by having to attach the lacquering unit to the rubber of the blanket cylinder.

A further disadvantage of the state of art as exemplified by the references cited hereinbefore, is that, due to the directions of rotation of the rollers, the format-related wiping by the ductor blade cannot be observed, thus making impossible a precise wiping or removal of the superfluous lacquer material.

It is, accordingly, an object of the invention to provide a device for applying a medium such as lacquering unit in a printing machine, wherein the medium, such as lacquer, has to travel over the shortest possible distance from the storage tank or supply container to the printed material, and wherein drying of the lacquer on the rollers is prevented, when the lacquering unit is connectible and disconnectible, as required.

With the foregoing and other objects in view, there is provided, in accordance with the invention, in a printing machine, a medium applicator disposed downstream of printing units of the machine in the travel direction of a sheet which has been printed, the applicator having three rollers including a first roller for taking up medium from a supply container, a second roller for metering a quantity of the medium to be applied, and a third roller having the same diameter as that of cylinders of the printing units for transferring the medium comprising a rubber lining disposed on the third roller for directly applying the medium onto the printed sheet; the three rollers, during application of the medium being in constant meshing engagement with a sheet-transferring cylinder; means for uncoupling the three rollers from the sheet-transferring cylinder, and separate motor means for driving the three rollers when the rollers are uncoupled.

In accordance with another feature of the invention, the third roller is in the form of a cylinder with a continuous surface.

Due to the fact that the cylinder surface of the applicator roller is not broken by a channel, the lacquer can be applied uniformly. Thus, the burdensome cleaning operations can be dispensed with. Because of the limitation to this relatively small number of rollers, it is possible, for example, to apply the lacquer directly to the sheet after the last ink impression i.e. to bring it on-line. When, for example, printed cardboard, which is to be converted afterwards into packaging material, is provided with such a lacquer layer, then this packaging material receives increased portection thereby which is of advantage during the subsequent transport operation. Moreover, the gloss provided by the lacquer enhances the effect of the impression. The cardboard or pastboard treated in this way is also better protected against environmental influence.

Because the rollers, during the application of the medium are in constant meshing contact with the cylinder, assurance is provided that the subsequent or further treatment of the surfaces of the printed material occurs at the speed of the printing machine.

Disengagement of the lacquering device from the cylinder provides the possibility of excluding a given portion of the impression from any subsequent treatment. The motor provided for driving the rollers of the applicator of lacquering prevents drying of the medium on the rollers. Thus, the burdensome cleaning activities can be dispensed with for the next operating cycle.

In accordance with a further feature of the invention, the rubber lining on the third roller is a rubber cloth applied in an abuttting manner, the third roller having the same diameter as that of the sheet-transferring cylinder; and the third roller being connected by a single-revolution clutch to the sheet-transferring cylinder.

It is thereby possible to use any type of cylinders, because, in this form of application of the rubber cloth or blanket also, no channel is formed in which the lacquer might otherwise accumulate. The third roller has the same diameter as a printing-unit cylinder.

In accordance with an added feature of the invention, there is provided a ductor blade disposed on at least one of the end faces of the third roller serving to transfer the medium to the printed sheet, the ductor blade being disposed so that when superfluous medium is removed by the ductor blade, the thus removed superfluous medum can flow back into the supply container. Thus, an economical use of the medium, in the further treatment is afforded thereby, and contamination of the printing machine is prevented.

In accordance with an additional feature of the invention, the third roller is in the form of a cylinder having a channel formed therein; and including an insert member received in channel so as to complete a continuous cylinder. By inserting a filling piece or insert member into this channel, which can be covered by a rubber cloth or blanket, the benefits of a full or solid cylinder can also be attained.

When such cylinders are used, in accordance with a concomitant feature of the invention, a ductor blade is disposed on the second roller. Thus, precise metering of the medium or lacquer occurs in conformity with the sheet format. A particularly advantageous metering process is also ensured due to the directions of rotation of the rollers, because, in this arrangement, the applcation of the lacquer is always effected from above.

Other features which are considered as characteristic for the invention are set forth in the appended claims.

Although the invention is illustrated and described herein as embodied in a device for applying medium after termination of the printing operation in a printing machine, it is nevertheless not intended to be limited to the details shown, since various modifications and structural changes may be made therien without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
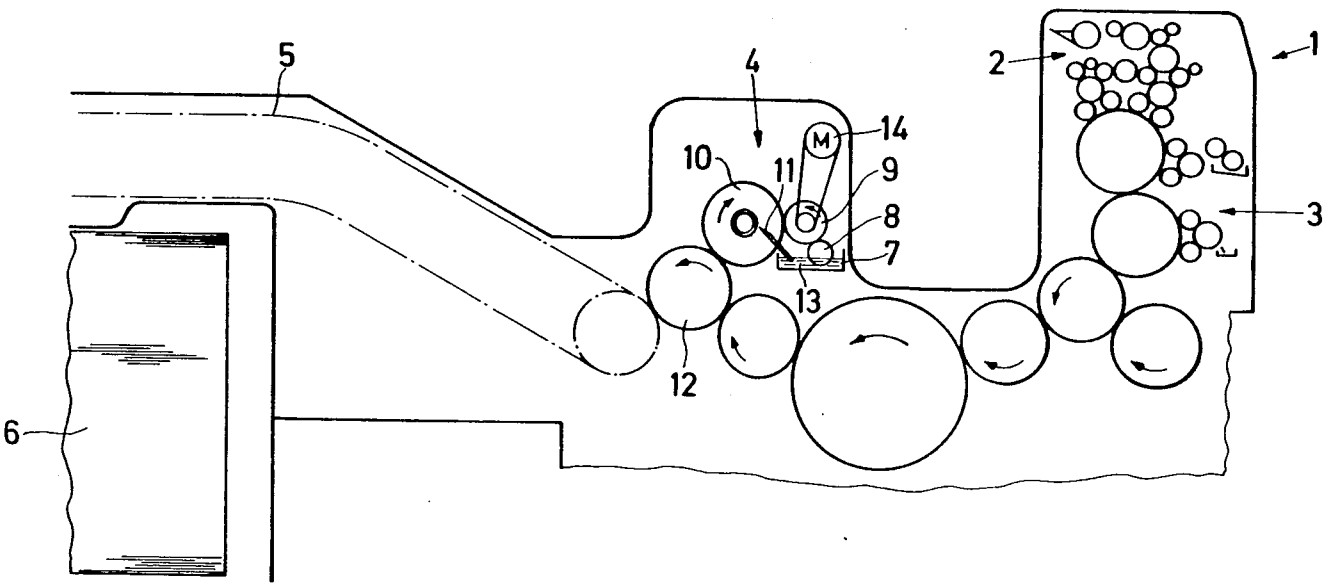
FIG. 1 is a diagrammatic elevational view of a printing machine with lacquering unit and a ductor blade assembly arranged at an applicator roller and disposed in front of the delivery unit.

Referring now to the drawing and first, particularly, to FIG. 1 thereof, there is shown a printing machine with a final last printing unit 1 equipped with a conventional inking unit 2 and a conventional dampening unit 3. This last printing unit 1 is followed by a lacquering unit 4. The printed sheets are fed by the last printing unit 1 to the lacquering unit 4. Subsequent to a final treatment of the sheets by the lacquering unit 4, the sheets are seized by a delivery chain 5 and thus transported to a delivery pile 6.

The lacquering unit 4 which is arranged downstream of or behind the last printing unit 1 in travel direction of the sheets is formed of a dipping roller 8 revolving within a supply container or tank 7, a metering roller 9 and an applicator roller 10 provided with a rubber lining or covering (not shown). At an end face of this applicator roller 10, there is additionally a ductor blade 11. The specific character of the applicator roller 10, which has the same diameter as that of a sheet transferring cylinder 12, is maintained both when it is covered with a separate rubber cloth or blanket and the channel formed therein covered by an insert member or a filling or loading piece, or, alternatively, when a rubber cloth of blanket is applied so that the leading and trailing edges thereof abut. Consequently, it is also possible to limit the applicaton of the lacquer to specific areas. The applicator roller 10 is in direct contact with the cylinder 12 which is provided with an elevator mechanism adapted to the sheet format and on which the printed sheet which is to be further processed is located. This cylinder 12 is equipped with non-illustrated grippers disposed in recesses i.e. the gripper back is at a deeper level than the surface of the sheet which is to be further processed. After the further processing has been completed, the cylinder 12 transfers the sheet to the conveyor or delivery chain 5 of the delivery unit which conveys the sheet to the deliver pile 6.

The storage tank or supply container 7 contains a medium or agent 13 to be used for the further treatment or processing of the printed sheets. This medium may be either a lacquer or a rubber cement or any other agent suited for this purpose. During the rotating movement of the dipping roller 8, the medium 13 is taken up thereby and subsequently transferred to the metering roller 9. The applicator roller 10 which is in direct contact with the metering roller 9 transfers the medium 13 to the surface of the printed sheet which is to be treated.

Because it is hardly possible to prevent the medium 13 from running down over the ends of the applicator roller 10, ductor blades 11 are disposed thereat. The medium 13 running down the ends of the applicator roller 10 is wiped off by the ductor blade 11 and flows back to the storage tank or supply container 7 for reuse. In this way, contamination of the printing machine is prevented and, at the same time, economical use of the medium 13 is enhanced.

The applicator roller 10 is controllable via an impression throw-off which is applied in such a manner that only the applicator roller 10 can be engageable with and retracted from the cylinder 12. Hence, the dipping roller 8, the metering roller 9 and the applicator roller 10 are always in mutual contact. During the application of the medium 13, the rollers 8, 9 and 10 of the lacquering unit 4 are driven via the drive mechanism of the printing machine. The further treatment or processing of the sheets thus occurs, at the operating and printing speed, respectively, of the machine.

When this further or subsequent treatment of the sheets is, for example, not required for a specific portion of the total impression or when the printing machine is stopped for a time, then the lacquering appliance 4 is disengaged from the cylinder 12. In order to prevent the medium 13 from drying on the rollers 8, 9 and 10 during this period of time, a motor 14 which is coupled to the metering roller 9 takes up the driving function and, thus, indirectly also the driving of the dripping roller 8 and of the applicator roller 10 which are in direct contact with the metering roller 9. In this regard the rollers 8, 9 and 10 need not rotate at fully machine speed. Only a few rotations per minute are thus required in order to prevent the drying of the medium 13.

A single-revolution coupling or clutch 24 (FIG. 3), for example, effects the disengagement or decoupling of the lacquering unit 4 from the cyliner 12 when the specific embodiment is one wherein the rubber cloth or blanket has been applied in an abutting manner on the applicator roller.

Figure 2:
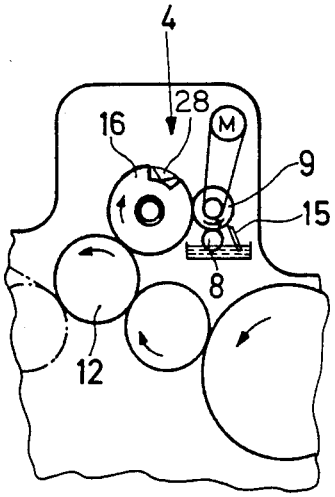
FIG. 2 is a fragmentary view of FIG. 1 showing the printing machine with lacquering unit and with a ductor blade arranged at a metering roller.

Another embodiment of the lacquering unit 4 is illustrated in FIG. 2. The dipping roller 8 revolves in the storage tank or supply container 7 filed up with the medium 13, takes up the medium and transfers it to the metering roller 9. A ductor blade 15 is disposed on this metering roller 9 for effecting metered transfer of the medium 13. This metering feature operating in correspondence with a particular format permits the use also of a cylinder 16 interrupted or broken by a channel as an applicator roller. This cylinder 16 is also in direct contact with the sheet-carrying cylinder 12. For effecting disengagement, a single-revolution clutch or coupling 24 (FIG. 3) is used in order that, when the lacquering unit is restarted, the cylinder 16 does not touch down on the sheet at the very place where the channel is located. The drive of the lacquering unit 4 is effected in the same manner as for that of the lacquering unit 4 illustrated in FIG. 1.

The embodiments of this lacquering unit 4 permit the use thereof at all times as another printing unit. Because the applicator roller 10 or the cyliner 16 are rollers covered with a rubber lining or blanket, the possibility is afforded of having an additional impression cylinder and inking unit available, without great expense.

Figure 3:
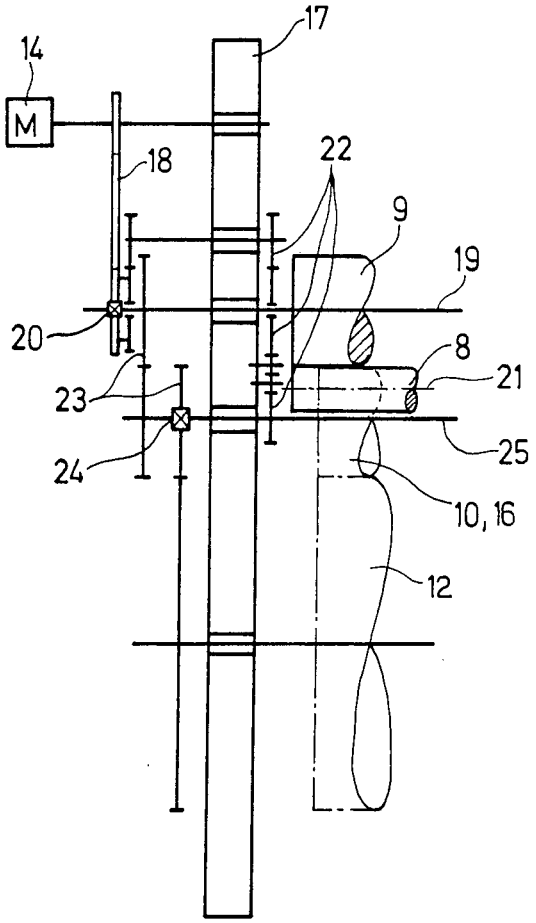
FIG. 3 is a diagrammatic side elevational view of the gearing and uncoupling mechanism for the rollers of the lacquering unit.

The uncouplability of the three rollers is represented in FIG. 3. The motor 14 is mounted in the side wall 17 located at the drive side of the printing machine, and drives a shaft 19 of the metering roller 9 via a belt 18 and a free-wheeling coupling 20. A shaft 21 of the dipping roller 8 is connected to the shaft 19 via gears 22. Likewise, a shaft 25 of the applicator roller 10 and of the cylinder 16, respectively, is coupled with the shaft 19 of the metering roller 9 via gears 23 and the single-revolution coupling or clutch 24.

Figure 4:
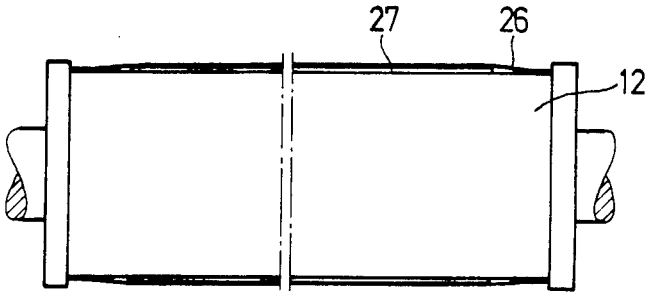
FIG. 4 is a diagrammatic axial view of a sheet transferring cylinder of the lacquering unit equipped with a format-related underlay.

The format-related underlay is shown in FIG. 4. Before a rubber blanket 26 is tightened on and around the cylinder 12, a previously calibrated sheet 27 accurately cut to the format being used is laid under. Assurance is thereby afforded that the application of lacquer will occur only in this region.

Figure 5:
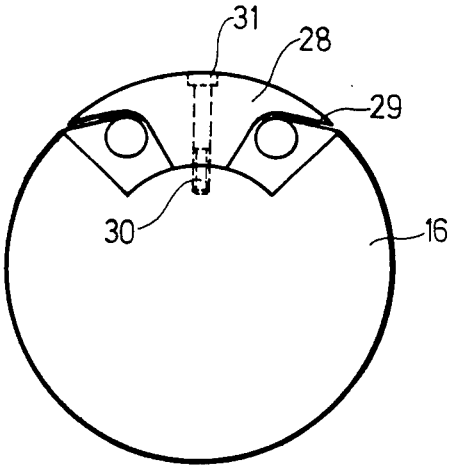
FIG. 5 is an end view of one of the rollers of the laquering unit which is formed with a longitudinal channel wherein an insert member is received.

In FIG. 5, an insert member or filling or loading piece 28 is shown received in a channel 29 formed in the cylinder 16. The insert member 28 which is accommodated to the diameter of the cylinder 16 is fastened in the cylinder channel 29 to the cylinder 16 by a spindle 30 and a screw 31.

Figure 6:
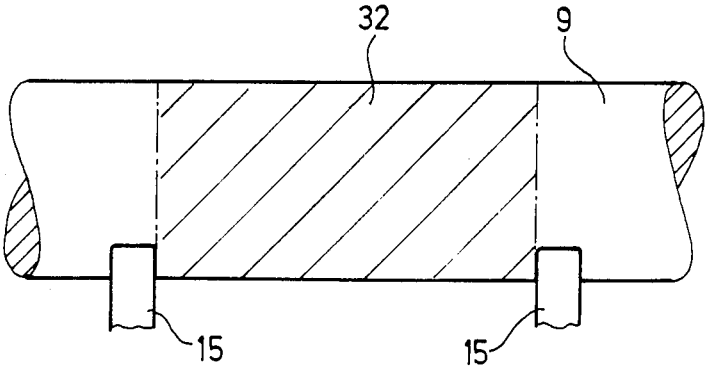
FIG. 6 is a diagrammatic longitudinal view of the metering roller of the lacquering unit and showing ductor blades disposed thereon.

As shown in FIG. 6, a lacquer layer 32 applied by the dipping roller 8 to the metering roller 9 is suitably doctored by the displaceably arranged doctor blade 15 in a manner related to the format of the sheet which is to be printed.

There is claimed:

1. In a printing machine, a medium applicator disposed downstream of printing units of the machine in the travel direction of a sheet which has been printed, the applicator having three rollers including a first roller for taking up medium from a supply container, a second roller for metering a quantity of the medium to be applied, and a third roller having the same diameter as that of cylinders of the printing units for transferring the medium, comprising a rubber lining disposed on the third roller for directly applying the medium onto the printed sheet; the three rollers, during application of the medium, being in constant meshing engagement with a sheet-transferring cylinder; means for uncoupling the three rollers from the sheet-transferring cylinder, and separate motor means for driving the three rollers when said rollers are uncoupled.

2. Medium applicator according to claim 1, wherein the third roller is in the form of a cylinder with a continuous surface.

3. Medium applicator according to claim 2 wherein the rubber lining is a rubber cloth applied in abutting manner on the third roller, the third roller having the same diameter as that of the sheet-transferring cylinder, and the third roller being connected by a single-revolution clutch to said sheet-transferring cylinder.

4. Medium applicator according to claim 1, including a ductor blade disposed on at least one of the end faces of the third roller serving to transfer the medium to the printed sheet, said ductor blade being disposed so that when superfluous medium is removed by the ductor blade, the thus removed superfluous medium can flow back into the supply container.

5. Medium applicator according to claim 1, wherein the third roller is in the form of a cylinder having a channel formed therein; and including an insert member received in said channel so as to complete a continuous cylinder.

6. Medium applicator according to claim 1 including a ductor blade disposed on the second roller for ensuring exact format-related metering of the medium.

* * * * *